US011946127B2

(12) United States Patent
Hashimoto et al.

(10) Patent No.: US 11,946,127 B2
(45) Date of Patent: Apr. 2, 2024

(54) CU—TI-BASED COPPER ALLOY SHEET MATERIAL, METHOD FOR PRODUCING THE SAME, ELECTRIC CURRENT CARRYING COMPONENT, AND HEAT RADIATION COMPONENT

(71) Applicant: DOWA METALTECH CO., LTD., Tokyo (JP)

(72) Inventors: Takuya Hashimoto, Tokyo (JP); Hiroshi Yorifuji, Tokyo (JP); Hiroshi Hyodo, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 0 days.

(21) Appl. No.: 18/118,793

(22) Filed: Mar. 8, 2023

(65) Prior Publication Data

US 2023/0313343 A1 Oct. 5, 2023

(30) Foreign Application Priority Data

Mar. 30, 2022 (JP) ..... 2022-055205
Aug. 1, 2022 (JP) ..... 2022-122576

(51) Int. Cl.
*C22C 9/00* (2006.01)
*C22F 1/08* (2006.01)

(52) U.S. Cl.
CPC ..... *C22C 9/00* (2013.01); *C22F 1/08* (2013.01); *Y10T 428/12431* (2015.01)

(58) Field of Classification Search
None
See application file for complete search history.

(56) References Cited

U.S. PATENT DOCUMENTS 9,412,482 B2 * 8/2016 Kamada ..... H01B 1/026
2010/0132851 A1 * 6/2010 Gao ..... C22C 9/00 148/414

(Continued)

FOREIGN PATENT DOCUMENTS

JP 2010-126777 6/2010
JP 2014-185370 10/2014

*Primary Examiner* — Seth Dumbris
(74) *Attorney, Agent, or Firm* — Clark & Brody LP

(57) ABSTRACT

[Object]
To provide a Cu—Ti-based copper alloy sheet material having a strength, an electrical conductivity, bending workability, and a stress relaxation property all at high levels in a good balance, and also having a reduced density (specific gravity).
[Means for Solution]
A copper alloy sheet material composed of, in mass %, Ti: 1.0 to 5.0%, Al: 0.5 to 3.0%, Ag: 0 to 0.3%, B: 0 to 0.3%, Be: 0 to 0.15%, Co: 0 to 1.0%, Cr: 0 to 1.0%, Fe: 0 to 1.0%, Mg: 0 to 0.5%, Mn: 0 to 1.5%, Nb: 0 to 0.5%, Ni: 0 to 1.0%, P: 0 to 0.2%, Si: 0 to 0.5%, Sn: 0 to 1.5%, V: 0 to 1.0%, Zn: 0 to 2.0%, Zr: 0 to 1.0%, S: 0 to 0.2%, rare earth elements: 0 to 3.0%, and the balance substantially being Cu, wherein a maximum width of a grain boundary reaction type precipitate existing region is 1000 nm or less, a KAM value when a boundary with a crystal orientation difference of 15° or more measured by EBSD (step size: 0.1 μm) is rewarded as a crystal grain boundary is 3.0° or less, and a tensile strength in a rolling direction is 850 MPa or more.

13 Claims, 3 Drawing Sheets

(56) References Cited

U.S. PATENT DOCUMENTS

| | | | | |
|---|---|---|---|---|
| 2014/0283963 | A1* | 9/2014 | Gao | H01B 1/026 148/414 |
| 2016/0201179 | A1* | 7/2016 | Miyagi | H01B 1/026 148/554 |
| 2018/0274074 | A1* | 9/2018 | Ito | H01B 5/02 |
| 2021/0238724 | A1* | 8/2021 | Shutoh | C22F 1/08 |

* cited by examiner

[Fig.1]
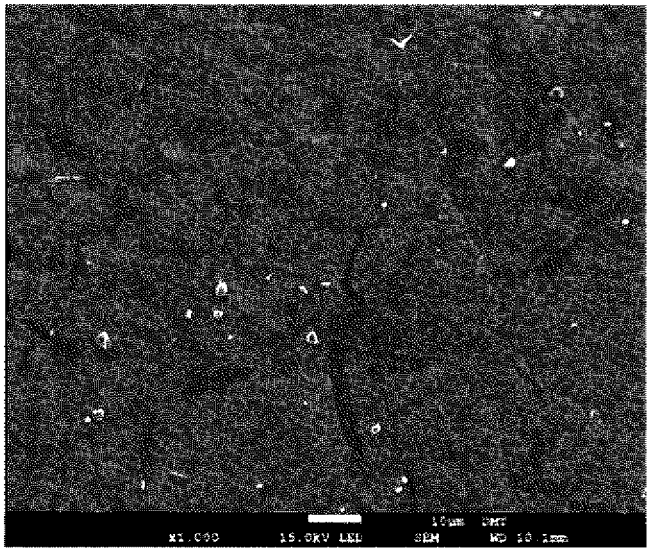
[Fig.2]
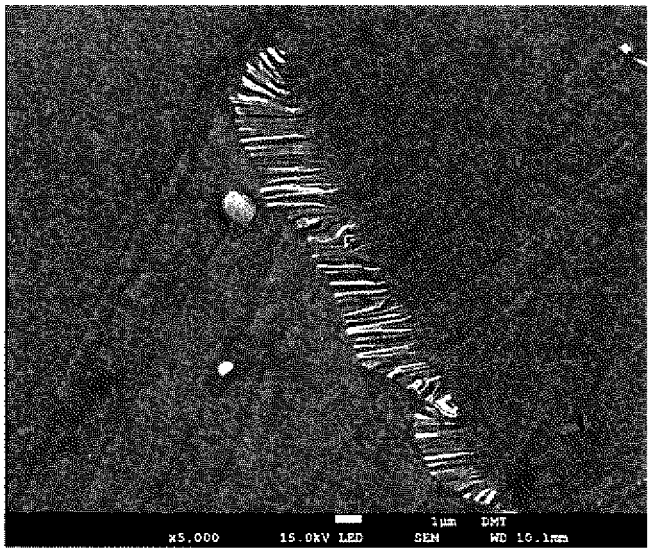

[Fig.3]
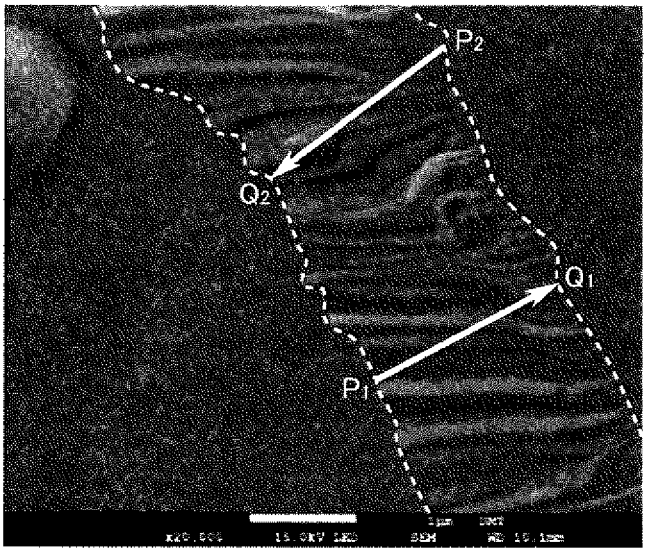
[Fig.4]
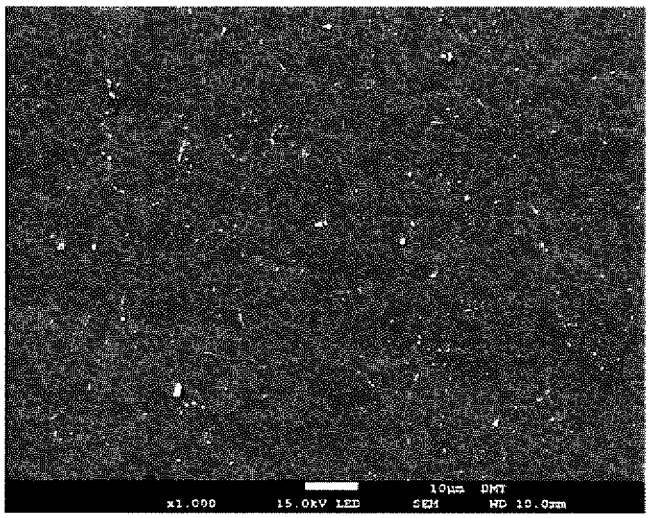

[Fig.5]
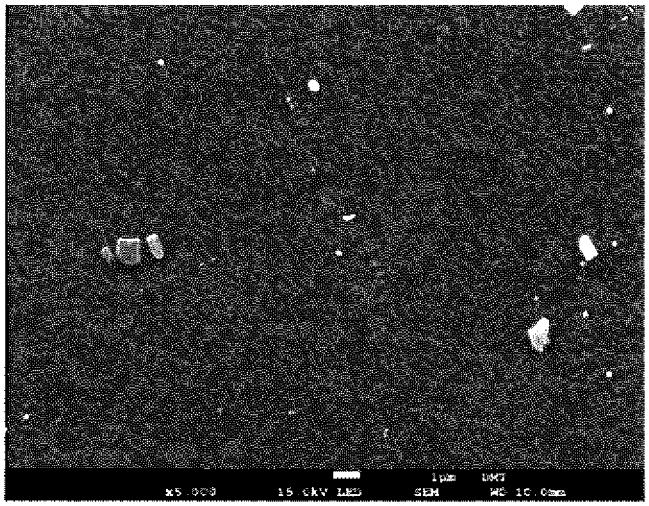
[Fig.6]
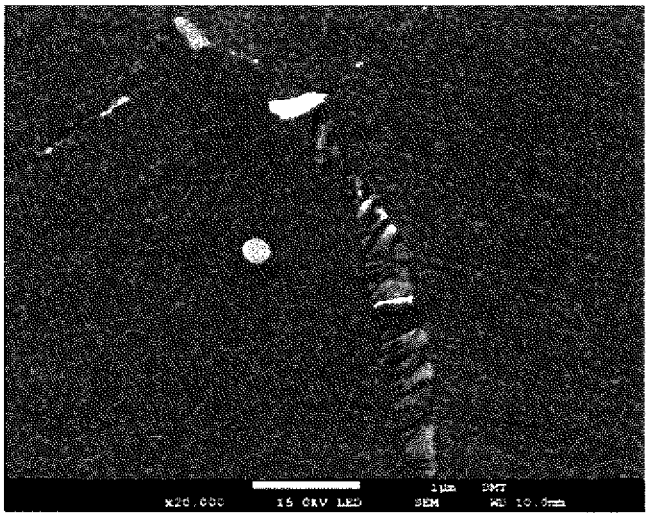

CU—TI-BASED COPPER ALLOY SHEET MATERIAL, METHOD FOR PRODUCING THE SAME, ELECTRIC CURRENT CARRYING COMPONENT, AND HEAT RADIATION COMPONENT

TECHNICAL FIELD

The present invention relates to a Cu—Ti-based copper alloy sheet material having a reduced density (specific gravity), a method for producing the same, and an electric current carrying component and the like using the sheet material as a material.

BACKGROUND ART

A Cu—Ti-based copper alloy (titanium copper) has a high strength level among various copper alloys and also has good stress relaxation resistance, and therefore is widely used as electric current carrying components such as a connector, a relay, and a switch, and spring components.

Recently, with the increase in functionality of mobile terminals such as a smartphone and electronic apparatuses for automobiles, there is an increasing demand for weight reduction of the individual constituent components to be used therefor. In order to meet this demand, it is important also for a copper alloy material to be used for an electric current carrying component to reduce the weight at the same time while maintaining the original good properties.

Patent Document 1 discloses a technique for improving the strength, bending workability, stress relaxation resistance, and fatigue resistance by suppressing the generation of a grain boundary reaction type precipitate in a Cu—Ti-based copper alloy through a step in which a preliminary aging treatment (precursory treatment) and an aging treatment in a relatively low temperature range are combined.

Patent Document 2 discloses a technique for improving the bending workability after notching by adjusting to a given texture in a Cu—Ti-based copper alloy through a step in which hot rolling for gaining a rolling reduction ratio in a high temperature range, a solution treatment at a relatively high temperature, and an aging treatment of controlling to the vicinity of a temperature at which the maximum hardness is obtained are combined.

PRIOR ART DOCUMENTS

Patent Documents

[Patent Document 1] JP-A-2014-185370
[Patent Document 2] JP-A-2010-126777

SUMMARY OF THE INVENTION

Problems that the Invention is to Solve

At present, due to the techniques disclosed in the above-mentioned Patent Documents 1 and 2 or the like, it becomes possible to industrially obtain a Cu—Ti-based copper alloy sheet material with improved desired properties depending on the application. However, no method for effectively reducing the density (specific gravity) of an alloy has been established. For example, in the techniques disclosed in Patent Documents 1 and 2, it is said that Al, which has a smaller atomic weight than Cu, can be added in an amount up to 1.0 mass %, but the content of Al in the material shown in Examples is 0.08% (Patent Document 1, Present Invention Example 6) and 0.14% (Patent Document 2, Example 9), and the effect of reducing the density is insufficient at this level of Al content. In addition, when the production of a Cu—Ti alloy sheet material to which Al is added in an amount of, for example, 0.5% or more in the production process disclosed in Patent Documents 1 and 2 is attempted, it is difficult to stably achieve both strength and bending workability at high levels.

An object of the present invention is to provide a Cu—Ti-based copper alloy sheet material having a strength, an electrical conductivity, bending workability, and a stress relaxation property all at high levels in a good balance, and also having a reduced density (specific gravity).

Means for Solving the Problems

As a result of detailed studies, the present inventors found that by adopting a production process of subjecting a Cu—Ti-based copper alloy having a density (specific gravity) reduced by including a predetermined amount of Al to an aging treatment after performing a step of "a solution treatment+intermediate cold rolling" twice, a sheet material in a structure state with little generation of coarse grain boundary reaction type precipitates and also with moderate lattice strain can be obtained, and thereby it becomes possible to impart excellent strength, electrical conductivity, bending workability, and stress relaxation property although Al is contained.

In order to achieve the above object, in the present specification, the following inventions are disclosed.

[1] A copper alloy sheet material, having a composition comprising, in mass %, Ti: 1.0 to 5.0%, Al: 0.5 to 3.0%, Ag: 0 to 0.3%, B: 0 to 0.3%, Be: 0 to 0.15%, Co: 0 to 1.0%, Cr: 0 to 1.0%, Fe: 0 to 1.0%, Mg: 0 to 0.5%, Mn: 0 to 1.5%, Nb: 0 to 0.5%, Ni: 0 to 1.0%, P: 0 to 0.2%, Si: 0 to 0.5%, Sn: 0 to 1.5%, V: 0 to 1.0%, Zn: 0 to 2.0%, Zr: 0 to 1.0%, and S: 0 to 0.2%, the total content of Ag, B, Be, Co, Cr, Fe, Mg, Mn, Nb, Ni, P, Si, Sn, V, Zn, Zr, and S among the elements being 3.0% or less, and the balance of Cu and unavoidable impurities, wherein in an observation plane parallel to a sheet surface, a maximum width of a grain boundary reaction type precipitate existing region is 1000 nm or less, a KAM value is 3.0° or less when a boundary with a crystal orientation difference of 150 or more in the measurement with a step size of 0.1 μm by EBSD (electron backscatter diffraction) of the observation plane parallel to the sheet surface is regarded as a crystal grain boundary, and a tensile strength in a rolling direction is 850 MPa or more.

[2] The copper alloy sheet material according to the above [1], having a composition further containing rare earth elements in an amount within a range of 3.0 mass % or less in total.

[3] The copper alloy sheet material according to the above [1] or [2], wherein a number density of fine precipitate particles having a major axis of 5 to 100 nm in the observation plane parallel to the sheet surface is $1.0\times10^8$ particles/$mm^2$ or more and $1.0\times10^{12}$ particles/$mm^2$ or less.

[4] The copper alloy sheet material according to any one of the above [1] to [3], wherein an average crystal grain diameter measured by a cutting method in accordance with JIS H 0501-1986 in the observation plane parallel to the sheet surface is 2 to 20 μm.

[5] The copper alloy sheet material according to any one of the above [1] to [4], wherein MBR/t is 2.0 or less, MBR/t being a ratio of a minimum bending radius MBR without cracking to a sheet thickness t in a W bending test in B.W.

in accordance with Japan Copper and Brass Association Technical Standard JCBA T307:2007.

[6] The copper alloy sheet material according to any one of the above [1] to [5], wherein an electrical conductivity is 10.0% IACS or more.

[7] The copper alloy sheet material according to any one of the above [1] to [6], wherein a density is 8.53 g/cm$^3$ or less.

[8] The copper alloy sheet material according to any one of the above [1] to [7], wherein a sheet thickness is 0.02 to 0.50 mm.

[9] A method for producing the copper alloy sheet material according to any one of the above [1] to [8], including a step of producing the copper alloy sheet material by subjecting an intermediate product sheet material having a composition specified in the above [1] to a first solution treatment, first intermediate cold rolling, a second solution treatment, second intermediate cold rolling, and an aging treatment in this order, wherein the first solution treatment is performed under the condition of holding in a temperature range of 750 to 950° C. for 10 to 600 seconds, the first intermediate cold rolling is performed at a rolling ratio of 70% or more, the second solution treatment is performed under the condition of holding in a temperature range of 750 to 900° C. for 10 to 600 seconds, the second intermediate cold rolling is performed at a rolling ratio of 15 to 50%, and the aging treatment is performed at an aging temperature of 300 to 470° C.

[10] The method for producing the copper alloy sheet material according to the above [9], wherein the intermediate product sheet material has a composition further containing rare earth elements in an amount within a range of 3.0 mass % or less in total.

[11] The method for producing the copper alloy sheet material according to the above [9] or [10], wherein in a step of producing the copper alloy sheet material by further performing finish cold rolling and low-temperature annealing in this order after the aging treatment, the finish cold rolling is performed at a rolling ratio of 50% or less, and the low-temperature annealing is performed under the condition of holding in a temperature range of 350 to 550° C. for 60 seconds or less.

[12] An electric current carrying component using the copper alloy sheet material according to any one of the above [1] to [8] as a material.

[13] A heat radiation component using the copper alloy sheet material according to any one of the above [1] to [8] as a material.

In the present specification, the "sheet material" means a sheet-shaped metal material formed by utilizing the malleability of a metal. A thin sheet-shaped metal material is sometimes called "foil", and such a "foil" is also included in the "sheet material" as used herein. A long sheet-shaped metal material coiled into a coil shape is also included in the "sheet material". In the present specification, the thickness of the sheet-shaped metal material is called "sheet thickness". In addition, the "sheet surface" is a surface perpendicular to the sheet thickness direction of the sheet material. The "sheet surface" is sometimes called "rolled surface".

In the present specification, the notation "n1 to n2" indicating a numerical range means "n1 or more and n2 or less". Here, n1 and n2 are numerical values satisfying n1<n2.

The Cu—Ti-based copper alloy generally exhibits a metallic structure in which a precipitate phase exists in a matrix (metal basis material). In the precipitate phase, there are "a grain boundary reaction type precipitate" that precipitates at a grain boundary, and "a granular precipitate" that precipitates in the other place. Such a precipitate phase is mainly composed of a Cu—Ti-based intermetallic compound, but an intermetallic compound such as an Ni—Ti-based, Co—Ti-based, Fe—Ti-based, or Cu—Ti—Al-based intermetallic compound may also exist depending on the type of alloy element to be added and the addition amount thereof. Among the granular precipitates, a very fine granular precipitate contributes to the improvement of the strength. Here, a particle of a fine granular precipitate having a major axis of 5 to 100 nm is called "fine precipitate particle". The grain boundary reaction type precipitate exists as an assembly of a group of layered particles in a crystal grain boundary portion. The appearance of the layered particle appearing on the observation plane varies depending on the angle at which the observation plane cuts the group of layered particles.

[How to Determine Maximum Width of Grain Boundary Reaction Type Precipitate Existing Region]

In an SEM (scanning electron microscope) image of an observation plane parallel to the sheet surface, among the distances from an arbitrary point on an outline of one grain boundary reaction type precipitate existing region composed of a group of adjacent layered particles to an outline on the crystal grain side facing the outline across a layered particle, the longest distance is defined as the width of the grain boundary reaction type precipitate existing region. At this time, the maximum value of the width of the grain boundary reaction type precipitate existing region observed in an observation region including a total of 10 or more grain boundary reaction type precipitate existing regions (randomly selected single or multiple non-overlapping fields of view) is defined as the maximum width of the grain boundary reaction type precipitate existing region of the sheet material.

In FIGS. 1 to 3, an SEM image of an observation plane parallel to the sheet surface of a Cu—Ti-based copper alloy sheet material (the below-mentioned Comparative Example No. 45) in which grain boundary reaction type precipitates were excessively generated is shown as an example. FIG. 3 is an enlarged image of a portion including a grain boundary reaction type precipitate existing region. In FIG. 3, the outline of the grain boundary reaction type precipitate existing region is indicated by a broken line. A distance from a point $P_1$ on the outline to an outline on the crystal grain side facing the outline across a layered particle is represented by the length of a segment $P_1Q_1$. A point $Q_1$ is a point closest to the point $P_1$ on the outline on the crystal grain side facing the point $P_1$. Similarly, a distance from a point $P_2$ on an outline to an outline on the crystal grain side facing the outline across a layered particle is represented by the length of a segment $P_2Q_2$. A point $Q_2$ is a point closest to the point $P_2$ on the outline on the crystal grain side facing the point $P_2$. When, with respect to all points on an outline, a distance to an outline on the crystal grain side facing the outline across a layered particle is determined, the maximum value of the distance becomes the width of the grain boundary reaction type precipitate existing region. With respect to an outline portion where "the facing outline on the crystal grain side" cannot be clearly specified such as an end portion of a grain boundary reaction type precipitate existing region in which crystal grains at both sides across a layered particle come in direct contact due to the crystal grain boundary, or the vicinity thereof, the "distance to the facing outline on the crystal grain side" at the point on the outline of the portion may be regarded as 0.

[How to Determine KAM Value]

The sheet surface (rolled surface) of a sheet material sample to be measured is finished by buffing, and thereafter smoothed by ion milling, whereby an observation plane is obtained. An observation region (for example, a 240×180 μm rectangular region) of a field of view corresponding to an observation magnification of 500 times is randomly set within the observation plane, and the observation region is irradiated with an electron beam with a step size of 0.1 μm by EBSD (electron backscatter diffraction), and crystal orientation data is collected, and based on the data, a KAM (Kernel Average Misorientation) value when a boundary with a crystal orientation difference at an adjacent measurement point of 15° or more is regarded as a crystal grain boundary is calculated using a software for EBSD data analysis. The KAM value corresponds to a value obtained by measuring a crystal orientation difference between all adjacent spots (hereinafter referred to as "adjacent spot orientation difference") with respect to electron beam irradiation spots disposed at a pitch of 0.1 μm, extracting only the measurement values of the adjacent spot orientation difference which is less than 15°, and determining the average value thereof. In the calculation of the KAM value, a twin boundary is also regarded as a crystal grain boundary.

[How to Determine Number Density of Fine Precipitate Particles]

An observation plane obtained by electropolishing the sheet surface under the following electropolishing conditions, and thereafter performing ultrasonic cleaning for 20 minutes in ethanol is observed with an FE-SEM (field emission scanning electron microscope) at a magnification of 100,000 times, and an observation field of view where a part or the whole of a particle having a major axis of 1.0 μm or more is not included in the field of view is randomly set. In the observation field of view, the number of precipitate particles having a major axis of 5 to 100 nm among the particles whose entire outline is visible is counted. This operation is performed for 10 or more observation fields of view with no overlapping regions, and a value obtained by dividing the total number of counts $N_{TOTAL}$ in all observed fields of view by the total area of the observation fields of view is converted into the number of precipitate particles per square millimeter, which is defined as the number density of fine precipitate particles (particles/$mm^2$). Here, the "major axis" of a certain particle is expressed as the diameter of the smallest circumscribed circle that surrounds the particle on the image.

(Electropolishing Conditions)

electrolytic solution: distilled water, phosphoric acid, ethanol, and 2-propanol are mixed at a volume ratio of 10:5:5:1 liquid temperature: 20° C.

voltage: 15 V electrolysis time: 20 seconds

[Advantage of the Invention]

According to the present invention, in a Cu—Ti-based copper alloy sheet material having a strength, an electrical conductivity, bending workability, and a stress relaxation property all at high levels in a good balance, one having a reduced density (specific gravity) of the alloy could be realized.

BRIEF DESCRIPTION OF THE DRAWINGS

FIG. 1 is an SEM photograph of an observation plane prepared by electropolishing a sheet surface of a Cu—Ti-based alloy sheet material obtained in Comparative Example No. 45.

FIG. 2 is an enlarged SEM photograph of a partial region of FIG. 1.

FIG. 3 is an enlarged SEM photograph of a partial region of FIG. 2.

FIG. 4 is an SEM photograph of an observation plane prepared by electropolishing a sheet surface of a Cu—Ti-based alloy sheet material obtained in Present Inventive Example No. 1.

FIG. 5 is an enlarged SEM photograph of a partial region of FIG. 4.

FIG. 6 is an enlarged SEM photograph of a partial region of FIG. 5.

MODE FOR CARRYING OUT THE INVENTION

[Chemical Composition]

Hereinafter, the symbol "%" regarding the alloy components means "mass %" unless otherwise specified.

Ti (titanium) is an element that brings about the formation of a modulated structure of Ti by spinodal decomposition or the formation of a fine second phase particle by precipitation and contributes to the increase in the strength of a Cu—Ti-based copper alloy. Ti also contributes to the improvement of the stress relaxation resistance or the reduction in the density (specific gravity). Here, an alloy having a Ti content of 1.0% or more is determined as the subject. The Ti content is more preferably 2.5% or more from the viewpoint of precipitation strengthening. An excessive inclusion of Ti not only becomes a factor that reduces the hot workability or cold workability, but also becomes a factor that reduces the bending workability, and therefore, the Ti content is set to 5.0% or less. The Ti content may be controlled to be 4.5% or less or 4.0% or less.

Al (aluminum) is an element effective in reducing the density (specific gravity) of a Cu—Ti-based copper alloy. In order to sufficiently exhibit the effect, it is necessary to contain Al in an amount of 0.5% or more. It is more effective to set the Al content to 0.7% or more, and further more effective to set the Al content to 1.0% or more. When Al is added in an amount of 0.5% or more to a Cu—Ti-based copper alloy, generally, there is a problem that it becomes difficult to achieve both strength and bending workability. However, the problem can be solved by the below-mentioned production method. Provided that when the Al content becomes too high, the electrical conductivity decreases, and therefore, the Al content is limited to 3.0% or less. The Al content is preferably 2.75% or less.

Ag (silver), B (boron), Be (beryllium), Co (cobalt), Cr (chromium), Fe (iron), Mg (magnesium), Mn (manganese), Nb (niobium), Ni (nickel), P (phosphorus), Si (silicon), Sn (tin), V (vanadium), Zn (zinc), Zr (zirconium), and S (sulfur) are optional elements. One or more types of these elements can be contained as needed. For example, each of Ni, Co, Fe, and Nb contributes to the improvement of the strength by forming an intermetallic compound with Ti. Further, the intermetallic compound of any of these elements suppresses the coarsening of crystal grains, and therefore, it becomes possible to perform a solution treatment in a higher temperature range in the production of a copper alloy sheet material, and it is advantageous for sufficiently solid-dissolved Ti. By sufficiently solid-dissolved Ti, suppression of the generation of a grain boundary reaction type precipitate and an increase in second phase particles contributing to the increase in the strength can be expected. Sn has a solid solution strengthening action and a stress relaxation resistance improving action. Zn not only improves the solderability and strength, but also is effective in improving the castability. Mg has a stress relaxation resistance improving action and a desulfurizing action. Si can form a compound with Ti, and contributes to the pinning during recrystallization in the production of a copper alloy sheet material, and may reduce the crystal grain diameter. Cr and Zr are effective in dispersion strengthening and suppressing the coarsening of crystal grains. Each of Mn and V easily forms a high melting-point compound with S or the like, and B and P have an effect of refining the cast structure, and therefore, each may contribute to the improvement of the hot workability The contents of the above-mentioned optional elements can be set within the following ranges: Ag: 0 to 0.3%, B: 0 to 0.3%, Be: 0 to 0.15%, Co: 0 to 1.0%, Cr: 0 to 1.0%, Fe: 0 to 1.0%, Mg: 0 to 0.5%, Mn: 0 to 1.5%, Nb: 0 to 0.5%, Ni: 0 to 1.0%, P: 0 to 0.2%, Si: 0 to 0.5%, Sn: 0 to 1.5%, V: 0 to 1.0%, Zn: 0 to 2.0%, Zr: 0 to 1.0%, and S: 0 to 0.2%. Further, the total content of these Ag, B, Be, Co, Cr, Fe, Mg, Mn, Ni, P, S, Si, Sn, V, Zn, and Zr is desirably set to 3.0% or less, more preferably set to 1.0% or less, and may be controlled to be 0.8% or less.

Further, the contents of the above-mentioned optional elements are more desirably set within the following ranges: Ag: 0 to 0.1%, B: 0 to 0.03%, Be: 0 to 0.05%, Co: 0 to 0.1%, Cr: 0 to 0.1%, Fe: 0 to 0.2%, Mg: 0 to 0.25%, Mn: 0 to 0.2%, Nb: 0 to 0.04%, Ni: 0 to 0.2%, P: 0 to 0.03%, S: 0 to 0.03%, Si: 0 to 0.15%, Sn: 0 to 0.8%, V: 0 to 0.03%, Zn: 0 to 0.2%, and Zr: 0 to 0.5%.

Further, the contents of the above-mentioned optional elements may be controlled within the following ranges: Ag: 0 to 0.08%, B: 0 to 0.02%, Be: 0 to 0.03%, Co: 0 to 0.08%, Cr: 0 to 0.08%, Fe: 0 to 0.18%, Mg: 0 to 0.2%, Mn: 0 to 0.18%, Nb: 0 to 0.03%, Ni: 0 to 0.18%, P: 0 to 0.02%, S: 0 to 0.02%, Si: 0 to 0.12%, Sn: 0 to 0.6%, V: 0 to 0.02%, Zn: 0 to 0.18%, and Zr: 0 to 0.4%.

As an element other than the above, a rare earth element (REM) can be incorporated. The rare earth element includes Sc (scandium), Y (yttrium), and lanthanide elements of Group 3 of the periodic table. The incorporation of the rare earth element is effective in refining crystal grains and dispersing precipitates. In order to favorably balance the surface properties, strength, and electrical conductivity of the sheet material, the total content of the rare earth elements in mass % is preferably set to 3.0% or less, more preferably set to 1.5% or less, or may be controlled to be 0.8% or less or 0.5% or less.

As a specific range of the content of the rare earth element, for example, in mass %, a range where the total content of the rare earth elements is 3.0% or less including at least one type selected from La (lanthanum): 2.0% or less, Ce (cerium): 1.8% or less, Pr (praseodymium): 0.3% or less, Nd (neodymium): 0.8% or less, Sm (samarium): 2.5% or less, and Y (yttrium): 2.5% or less can be exemplified.

As a range of the content of the rare earth element in consideration of economic efficiency and manufacturability, for example, in mass %, a range where the total content of the rare earth elements is 1.5% or less including at least one type selected from La: 0.8% or less, Ce: 0.7% or less, Pr: 0.1% or less, Nd: 0.2% or less, Sm: 1.0% or less, and Y: 1.0% or less can be exemplified. As a more preferred range of the content of the rare earth element in further consideration of economic efficiency and manufacturability, for example, in mass %, a range where the total content of the rare earth elements is 0.8% or less including at least one type selected from La: 0.35% or less, Ce: 0.32% or less, Pr: 0.04% or less, Nd: 0.1% or less, Sm: 0.5% or less, and Y: 0.5% or less can be exemplified.

[Maximum Width of Grain Boundary Reaction Type Precipitate Existing Region]

In a Cu—Ti-based copper alloy, a grain boundary reaction type precipitate is likely to be generated. The grain boundary reaction type precipitate becomes a factor that deteriorates the bending workability. If it is adjusted to a soft structure state, it is possible to maintain the bending workability good to some extent even if many grain boundary reaction type precipitates are generated. However, it was found that in order to achieve both strength and bending workability at high levels in a Cu—Ti-based copper alloy sheet material, it is important to control the metallic structure so that the maximum width of a grain boundary reaction type precipitate existing region becomes small. Specifically, in the copper alloy sheet material of the present invention, a structure state in which the maximum width of a grain boundary reaction type precipitate existing region in an observation plane parallel to the sheet surface specified according to the above-mentioned "How to Determine Maximum Width of Grain Boundary Reaction Type Precipitate Existing Region" is 1000 nm or less is adopted. In order to reduce the maximum width of a grain boundary reaction type precipitate existing region, it is extremely effective to adopt the below-mentioned production process capable of reducing the crystal grain diameter. In the SEM image described in the above-mentioned "How to Determine Maximum Width of Grain Boundary Reaction Type Precipitate Existing Region", in a case where a grain boundary reaction type precipitate existing region is not observed, this case shall fall under the case where "the maximum width of the grain boundary reaction type precipitate existing region is 1000 nm or less".

[KAM Value]

In order to achieve both strength and bending workability at high levels, it is also important that the KAM value is not too high. The KAM value is one of the indices capable of evaluating the lattice strain in a crystal grain. As a result of studies, in the copper alloy sheet material of the present invention, a structure state in which the KAM value determined according to the above-mentioned "How to Determine KAM Value" is 3.0° or less is adopted. The lower limit of the KAM value is not particularly limited as long as a sufficient strength is obtained, but may be generally adjusted within a range of 0.5° or more. From the viewpoint of achievement of both strength and bending workability, and manufacturability, the KAM value is more preferably within a range of 0.6 to 2.0.

[Tensile Strength]

The tensile strength in the rolling direction of the copper alloy sheet material of the present invention is preferably 850 MPa or more, and more preferably 880 MPa or more. It is also possible to adjust the tensile strength in the rolling direction to a level as high as 1000 MPa or more. The upper limit of the tensile strength is not particularly limited, but may be adjusted within a range of, for example, 1400 MPa or less, and may also be adjusted within a range of 1200 MPa or less.

[Number Density of Fine Precipitate Particles]

The fine precipitate particles having a major axis of 5 to 100 nm contribute to the improvement of the strength by existing in a dispersed state in a matrix (metal basis material). The number density of fine precipitate particles having a major axis of 5 to 100 nm is preferably $1.0\times10^8$ particles/$mm^2$ or more. On the other hand, too many fine precipitate particles may adversely affect the bending workability, and therefore, the number density of fine precipitate particles having a major axis of 5 to 100 nm is preferably within a range of $1.0\times10^{12}$ particles/$mm^2$ or less. The higher the Ti content is, the larger the amount of generated fine precipitate particles tends to be.

[Average Crystal Grain Diameter]

The smaller the average crystal grain diameter is, the more the generation sites of grain boundary reaction type precipitates can be dispersed during the aging treatment in the production of a copper alloy sheet material, and it is advantageous for reducing the above-mentioned maximum width of the grain boundary reaction type precipitate existing region. In addition, it is also advantageous for improving the strength. The copper alloy sheet material of the present invention has an average crystal grain diameter measured by a cutting method in accordance with JIS H 0501-1986 in an observation plane parallel to the sheet surface of preferably, for example, 20 μm or less, more preferably 16 μm or less, and further more preferably 5 μm or less. It is not preferred to excessively reduce the average crystal grain diameter from the viewpoint of causing an increase in the process load. In general, the average crystal grain diameter may be set within a range of 2 μm or more. The below-mentioned production process in which a solution treatment is performed twice is effective in refining crystal grains. According to the cutting method specified in JIS H 0501-1986, it is said that "it is expressed as the average value (mm) of the cut length", however, the crystal grain diameter aimed at by the present invention is very small with respect to the predetermined noted unit, and therefore, here, measurement in accordance with the standard method is performed in an observation field of view at a higher magnification, and the average crystal grain diameter in a unit of pm is determined.

[Bending Workability]

Bending is often involved when processing into an electric current carrying component or the like. When a Cu—Ti-based alloy has bending workability such that MBR/t, the ratio of the minimum bending radius MBR without cracking to the sheet thickness t in a W bending test in B.W. in accordance with Japan Copper and Brass Association Technical Standard JCBA T307:2007 is 2.5 or less, it can be applied to many electric current carrying components. However, the present invention aims at bending workability such that the above MBR/t is 2.0 or less as a stricter standard. The B.W. (Bad Way) means that the bending axis becomes parallel to the rolling direction. The MBR/t of the copper alloy sheet material of the present invention is preferably 1.0 or less, more preferably 0.7 or less, and further more preferably 0.0.

In JCBA T307:2007, it is described that "This standard is applied to the evaluation of the bending workability of copper and copper alloy sheets and strips with a thickness of 0.1 mm or more and 0.8 mm or less". According to the studies by the present inventors, it was confirmed that also for a Cu—Ti-based copper alloy sheet material having a sheet thickness less than 0.1 mm, the bending workability can be evaluated by a W bending test using the method described in this standard. Therefore, in the present invention, the W bending test method in B.W. described in JCBA T307:2007 is directly applied extending to the case where the sheet thickness is less than 0.1 mm (for example, 0.02 mm or more and less than 0.1 mm).

[Electrical Conductivity]

In consideration of the application of the Cu—Ti-based copper alloy sheet material, the electrical conductivity is desirably 10.0% IACS or more. The upper limit of the electrical conductivity is not particularly limited, but generally may be adjusted within a range of 20.0% IACS or less.

[Stress Relaxation Property]

In consideration of the application of the Cu—Ti-based copper alloy sheet material, the stress relaxation ratio after it is held at 250° C. for 100 hours is desirably 15% or less. The lower limit of the stress relaxation ratio is not particularly limited, but the stress relaxation ratio is generally 3% or more.

[Density]

The order of the atomic weight of Cu, Ti, and Al is as follows: Cu>Ti>Al, and therefore, it is most effective to increase the Al content for reducing the density (specific gravity) of the Cu—Ti-based copper alloy, and also the effect of the Ti content cannot be ignored. Although the contents of Al and Ti are subjected to restrictions in order to maintain all the strength, bending workability, electrical conductivity, and stress relaxation property within the above-mentioned favorable ranges, but according to the present invention, the density at 20° C. can be reduced to 8.53 g/$cm^3$ or less. In the Cu—Ti-based copper alloy, it was difficult with the conventional technique to reduce the density to 8.53 g/$cm^3$ or less while maintaining all the strength, bending workability, electrical conductivity, and stress relaxation property within the above-mentioned favorable ranges. The lower limit of the density is not particularly limited, but may be adjusted within a range of, for example, 7.8 g/$cm^3$ or more.

[Production Method]

The copper alloy sheet material described above can be produced by, for example, the following production process. Melting and casting→cast slab heating→hot working→rough cold rolling→first solution treatment→first intermediate cold rolling→second solution treatment→second intermediate cold rolling→aging treatment→(finish cold rolling)→(low-temperature annealing)

In the above description, the steps in parentheses can be omitted. Although the description is omitted in the above-mentioned process, surface grinding is performed as needed after hot working, and after each heat treatment, pickling, polishing, or further degreasing is performed as needed. Hereinafter, the above-mentioned respective steps will be described.

[Melting and Casting]

A cast slab having a chemical composition specified in the present invention may be produced using a crucible furnace or the like. In order to prevent oxidation of Ti and Al, the production may be performed in an inert gas atmosphere or in a vacuum melting furnace.

[Cast Slab Heating]

The cast slab heating before hot working can be carried out, for example, by a method of holding at 900 to 960° C. for 0.5 to 5 hours.

[Hot Working and Rough Cold Rolling]

A method for hot working is not particularly limited. In general, hot forging or hot rolling is adopted. In the case of hot rolling, the total hot rolling ratio may be set to, for example, 60 to 99%. After completion of the hot working, it is preferred to perform rapid cooling by water cooling or the like. Subsequently, cold rolling is performed. In the present specification, the cold rolling at this stage is referred to as "rough cold rolling". The rolling ratio in the rough cold rolling can be set to, for example, 50 to 99%. In this manner, an intermediate product sheet material to be subjected to the first solution treatment can be obtained.

Here, the rolling ratio is represented by the following formula (1).

$$\text{Rolling ratio (\%)}=100\times(t_0-t_1)/t_0 \quad (1)$$

$t_0$: sheet thickness before rolling (mm)

$t_1$: sheet thickness after rolling (mm)

[First Solution Treatment]

The intermediate product sheet material is subjected to the first solution treatment. In this solution treatment, recrystallization is caused by utilizing strain introduced by hot working or rough cold rolling, and coarse grain boundary reaction type precipitates or granular precipitates generated after casting or during hot working are sufficiently solid-dissolved. If the solid-dissolution of the precipitates is insufficient at this stage of the first solution treatment, the precipitates remain until the final step, and the desired properties cannot be obtained. In the first solution treatment, it is advantageous to increase the amount of introduced heat energy in order to give priority to solid-dissolution. In this case, recrystallized grains tend to grow, but there is no problem because refinement of the crystal grains is attempted in the second solution treatment later. The first solution treatment can be carried out under the condition of holding in a temperature range of 750 to 950° C. for 10 to 600 seconds, and more preferably under the condition of holding at 800 to 900° C. for 20 to 600 seconds.

[First Intermediate Cold Rolling]

The cold rolling to be performed for the material after being subjected to the first solution treatment is referred to as "first intermediate cold rolling". The purpose of the first intermediate cold rolling is to introduce strain as well as to reduce the sheet thickness. If the introduction of strain is insufficient, nucleation sites for recrystallization cannot be sufficiently ensured in the subsequent second solution treatment, and it becomes difficult to refine crystal grains. For the above reason, it is necessary to set the rolling ratio to 70% or more in the first intermediate cold rolling. It is more effective to set it to 85% or more, and further more effective to set it to 90% or more. The upper limit of the rolling ratio is not particularly limited, but generally may be set within a range of 99% or less according to the ability of a cold rolling mill.

[Second Solution Treatment]

In the material after being subjected to the first intermediate cold rolling, the precipitates have already been sufficiently solid-dissolved, and strain has been introduced into the crystals of the matrix (metal basis material). The sheet material in such a structure state is subjected to the second solution treatment. In this solution treatment, new recrystallization is caused in many places by utilizing the strain introduced by the first intermediate cold rolling to attempt to refine crystal grains. The main purpose is not to solid-dissolve the precipitates, but to refine the crystal grains by recrystallization, and therefore, the allowable upper limit of the heating temperature is lower than that of the first solution treatment. Specifically, it can be carried out under the condition of holding in a temperature range of 750 to 900° C. for 10 to 600 seconds. When the temperature exceeds 900° C., grain growth accompanied by grain boundary migration between recrystallized grains is more likely to occur, and the crystal grains may be coarsened. Further, when the temperature is lower than 750° C., precipitation is more likely to occur instead of recrystallization, and it becomes difficult to sufficiently generate fine precipitates in the below-mentioned aging treatment. The second solution treatment is more preferably performed under the condition of holding in a temperature range of 750 to 880° C. for 10 to 300 seconds, and further more preferably under the condition of holding in a temperature range of 750 to 860° C. for 10 to 150 seconds. In addition, from the viewpoint of favorably achieving the purpose of the second solution treatment of attempting to refine crystal grains, it is more effective that a heating temperature 2 in the second solution treatment is lower than a heating temperature 1 in the first solution treatment, and further, when the heating temperature 2 is a temperature equal to or higher than the heating temperature 1, it is more effective that the difference therebetween is 50° C. or less, and a holding time 2 at the heating temperature 2 in the second solution treatment is ⅓ or less of a holding time 1 at the heating temperature 1 in the first solution treatment.

[Second Intermediate Cold Rolling]

The cold rolling to be performed for the material after being subjected to the second solution treatment is referred to as "second intermediate cold rolling". In the second intermediate cold rolling, moderate strain is introduced so as to promote the generation of fine precipitates in crystal grains in the subsequent aging treatment. In addition, this strain also contributes to the improvement of the strength. If the amount of the introduced strain is too large, the structure state eventually becomes such that the KAM value is too high, which may lead to a decrease in bending workability. Therefore, the rolling ratio in the second intermediate cold rolling cannot be set high as in the first intermediate cold rolling. Specifically, it is necessary to set the rolling ratio in the second intermediate cold rolling within a range of 15 to 50%. It is more preferably set within a range of 15 to 40%, and may be controlled within a range of 15 to 35%.

[Aging Treatment]

The material after being subjected to the second intermediate cold rolling is subjected to the aging treatment at 300 to 470° C., preferably at 320 to 450° C. so as to generate fine precipitates that contribute to the strength. By the aging treatment, grain boundary reaction type precipitates are also generated, but the crystal grains have already been refined, and therefore, the generation sites of the grain boundary reaction type precipitates are dispersed in the material, and a metallic structure in which the above-mentioned "maximum width of the grain boundary reaction type precipitate existing region" is small is obtained. With respect to the aging treatment time (the holding time at 300 to 470° C.), generally, an aging treatment time in which a sufficient effect is obtained can be set within a range of 1 to 24 hours. It is preferred to set the aging treatment time, for example, within a range of 8 to 20 hours.

[Finish Cold Rolling and Low-Temperature Annealing]

After the aging treatment, cold rolling and low-temperature annealing can be performed as needed for the purpose of adjusting the sheet thickness, improving the strength, or the like. The cold rolling at this stage is referred to as "finish cold rolling". If the rolling ratio in the finish cold rolling is too high, the structure state becomes such that the KAM value is too high, which may lead to a decrease in bending workability. It is necessary to set the rolling ratio to 50% or less in the finish cold rolling, and it is more preferably to set to 30% or less, and may be controlled within a range of 25% or less. In order to improve the strength, it is effective to ensure a rolling ratio of 5% or more, and it is more effective to set the rolling ratio to 10% or more. The low-temperature annealing can be carried out under the condition of holding in a temperature range of 350 to 550° C., preferably 400 to 500° C. for 60 seconds or less. It is effective to ensure a holding time of 15 seconds or more in the above-mentioned temperature range.

The final sheet thickness can be set, for example, within a range of 0.02 to 0.50 mm.

[Electric Current Carrying Component]

The copper alloy sheet material of the present invention described above has a strength, an electrical conductivity, bending workability, and a stress relaxation property all at high levels in a good balance, and also has a reduced density (specific gravity), and therefore, an electric current carrying component using this sheet material as a material meets the recent demand for an increase in functionality of mobile terminals and electronic apparatuses for automobiles.

[Heat Radiation Component]

The copper alloy sheet material of the present invention described above has a strength, an electrical conductivity, bending workability, and a stress relaxation property all at high levels in a good balance (a material having an excellent electrical conductivity generally has an excellent heat radiation property), and also has a reduced density (specific gravity), and therefore, a heat radiation component using this sheet material as a material meets the recent demand for an increase in functionality of mobile terminals and electronic apparatuses for automobiles.

EXAMPLES

Each of copper alloys having a chemical composition shown in Table 1 was melted and cast. In Present Inventive Example No. 14, a misch metal (a mixture of rare earth elements) was added as an addition source of rare earth elements at a ratio of 0.32 mass % in the total amount of the copper alloy raw material. The mass ratio of the main rare earth elements contained in this misch metal was as follows: La:Ce:Pr:Nd=28:50:5:17.

Each of the obtained cast slabs was heated at a temperature for a period of time shown in Table 2 or 3. Except for some examples (Comparative Examples Nos. 40 and 41), the cast slab was taken out of a heating furnace, and hot rolled to a sheet thickness shown in Table 2 or 3, and then cooled with water. The total hot rolling ratio is 87.5 to 95%. After hot rolling, the oxidized layer of the surface layer was removed by mechanical polishing (surface grinding), and each hot rolled material was cold rolled to a sheet thickness shown in the column of "rough cold rolling" in Table 2 or 3.

Thereafter, except for some examples (Comparative Examples Nos. 31, 38, 39, 40, 41, and 45), the first solution treatment, the first intermediate cold rolling, the second solution treatment, the second intermediate cold rolling, and the aging treatment were performed in this order under the conditions shown in Table 2 or 3. The aging treatment was performed in a nitrogen atmosphere using a batch-type heat treatment furnace. With respect to Present Inventive Examples Nos. 4, 5, and 11, and Comparative Example 37, the finish cold rolling and the low-temperature annealing were performed under the conditions shown in Table 2 or 3 after the aging treatment. The notation "-" (hyphen) in Tables 2 and 3 means that the step was omitted. In Nos. 31, 39, and 45, the first intermediate cold rolling and the second solution treatment were omitted. In No. 38, a step in which a preliminary aging treatment (precursory treatment) is performed after the solution treatment, and thereafter, cold rolling at a light rolling ratio and then the aging treatment are performed was adopted. In No. 40, a step in which a cast slab after being subjected to a heat treatment for homogenization is directly subjected to the aging treatment was adopted, and hot rolling and cold rolling are not performed. In No. 41, a step in which a cast slab after being subjected to a heat treatment for homogenization is subjected to cold rolling at a rolling ratio of 85% to a sheet thickness of 0.10 mm, and thereafter, the solution treatment and the aging treatment are performed was adopted, and hot rolling is not performed. In Tables 2 and 3, the sheet thickness of each of the finally obtained sheet materials is shown. The sheet materials were used as sample materials and subjected to the following examinations. In Example No. 40, the rolling step was not performed, and therefore, a test piece obtained by etching a sample cut out of the material after being subjected to the aging treatment so as to adjust the sheet thickness to 0.08 mm was used as the sample material. With respect to the density (specific gravity), the measurement was performed using a block sample cut out of the material at the stage after completion of the cast slab heating.

(Average Crystal Grain Diameter)

The sheet surface of the sample material was polished and then electropolished by adopting the electropolishing conditions described in the above-mentioned "How to Determine Number Density of Fine Precipitate Particles", and the resulting finished surface was etched, whereby an observation plane was prepared. The observation plane was observed with a light microscope at a magnification of 1000 times, and an observation image was obtained. A total of three straight lines parallel to the rolled surface were drawn, and the number of crystal grain boundaries cut by each of the straight lines by the cutting method in accordance with JIS H 0501-1986 is counted, and an average value of the crystal grain diameters in the observation field of view was calculated. This operation was performed for randomly selected 5 fields of view, and the arithmetic mean value of the average values of the crystal grain diameters obtained in the respective fields of view was adopted as the average crystal grain diameter of the sheet material. As the light microscope, LEXT OLS4000 manufactured by Olympus Corporation was used.

(Maximum Width of Grain Boundary Reaction Type Precipitate Existing Region)

The sheet surface of the sample material was polished and then electropolished by adopting the electropolishing conditions described in the above-mentioned "How to Determine Number Density of Fine Precipitate Particles", and the resulting finished observation plane was observed with an SEM (scanning electron microscope), and then, the maximum width of the grain boundary reaction type precipitate existing region was determined according to the above-mentioned "How to Determine Maximum Width of Grain Boundary Reaction Type Precipitate Existing Region".

(Number Density of Fine Precipitate Particles) The number density of fine precipitate particles was determined according to the above-mentioned "How to Determine Number Density of Fine Precipitate Particles".

(KAM Value)

The sheet surface of a sample cut out of the sample material was polished by buffing, and thereafter polished by ion milling, whereby a sample surface for EBSD (electron backscatter diffraction) measurement was prepared. The sample surface was observed with FE-SEM (JSM-7200F manufactured by JEOL Ltd.) under the conditions of an accelerating voltage of 15 kV and a magnification of 500 times, and with respect to a rectangular measurement region of 240 μm×180 μm in the sheet thickness direction, by using an EBSD device (manufactured by Oxford Instruments, Symmetry) installed in the FE-SEM, crystal orientation data was collected with a step size of 0.1 μm by the EBSD method. A KAM value was determined based on the crystal orientation data measured for the measurement regions in 5 fields of view according to the above-mentioned "How to Determine KAM Value". As the software for EBSD data analysis, OIM Analysis 7.3.1. manufactured by TSL Solutions, LTD. was used.

(Tensile Strength)

A tensile test piece (JIS No. 5) in the rolling direction (in any direction in the case of Example No. 40) was collected from each of the sample materials, and subjected to a tensile test in accordance with JIS Z 2241 with the number of tests n=3, and the tensile strength was measured. The average value of n=3 was used as the performance value of the sample material. Further, the value of 0.2% proof stress determined by this tensile test was used in the measurement of the below-mentioned stress relaxation ratio.

(Electrical Conductivity)

The electrical conductivity of each of the sample materials was measured by a double bridge and an average cross sectional area method in accordance with JIS H 0505.

(MBR/t of 90° W Bending)

MBR/t, the ratio of the minimum bending radius MBR without cracking to the sheet thickness t in a W bending test in B.W. in accordance with Japan Copper and Brass Association Technical Standard JCBA T307:2007 was determined. As for the size of the test piece, the length in the direction perpendicular to the rolling direction was set to 30 mm, and the length in the rolling direction was set to 10 mm. However, in the case of Example No. 40, any direction was taken as the longitudinal direction. A bending test was performed with the bending radius changed stepwise with the number of tests n=3 for one bending radius, and the minimum bending radius at which no cracks were observed on the surface of the bent portion in all three test pieces was defined as the MBR of the sample material. The determination as to whether or not a crack occurs on the surface of the bent portion was performed in accordance with JCBA T307:2007. In the appearance observation of the surface of the bent portion, with respect to the sample determined as follows: "wrinkle: large", a sample cut perpendicular to the bending axis direction for a portion of the deepest wrinkle was prepared, and it was confirmed whether or not a crack that propagates into the sheet thickness has occurred by observing a polished cross section thereof with a light microscope. In a case where such a crack has not occurred, it was evaluated to be "no cracks are observed".

(Stress Relaxation Ratio)

A test piece with a width of 10 mm in the direction perpendicular to the rolling direction (in any direction in the case of Example No. 40) was cut out of the sample material, and the stress relaxation ratio was measured by a cantilever method in accordance with Japan Copper and Brass Association Technical Standard JCBA T309:2004. The test piece was set in a state where a load stress equivalent to 80% of the 0.2% proof stress was applied so that the deflection displacement was in the sheet thickness direction, and the stress relaxation ratio after holding at 250° C. for 100 hours was measured. If the stress relaxation ratio is 15% or less under the conditions, it can be determined that the Cu—Ti-based copper alloy sheet material has good stress relaxation resistance.

(Density)

By using a block sample with a mass of 10 g cut out of the material at the stage after completion of the cast slab heating, the density at normal temperature (20° C.) was measured by the Archimedes' method (weight-in-water method).

The above results are shown in Tables 4 and 5.

TABLE 1

| Category | Example No. | Chemical composition (mass %) Cu | Ti | Al | Others |
|---|---|---|---|---|---|
| Present Inventive Example | 1 | balance | 3.33 | 1.01 | Fe: 0.1, V: 0.01 |
| | 2 | balance | 4.81 | 0.80 | Si: 0.05 |
| | 3 | balance | 1.40 | 2.70 | Zr: 0.2 |
| | 4 | balance | 3.21 | 1.10 | Mn: 0.1, P: 0.01 |
| | 5 | balance | 3.31 | 0.95 | Zn: 0.1 |
| | 6 | balance | 3.50 | 0.55 | Sn: 0.5, Mg: 0.15 |
| | 7 | balance | 3.20 | 2.85 | Ni: 0.1, B: 0.01 |
| | 8 | balance | 3.60 | 0.95 | Co: 0.05, Cr: 0.05 |
| | 9 | balance | 3.24 | 1.10 | — |
| | 10 | balance | 3.20 | 2.00 | S: 0.01 |
| | 11 | balance | 3.19 | 1.10 | — |
| | 12 | balance | 2.50 | 1.12 | Fe: 0.1 |
| | 13 | balance | 4.20 | 1.06 | Nb: 0.02 |
| | 14 | balance | 3.41 | 1.11 | La: 0.09, Ce: 0.16, Pr: 0.02, Nd: 0.05 |
| | 15 | balance | 3.25 | 1.04 | La: 0.18, Y: 0.25 |
| | 16 | balance | 3.31 | 1.08 | Sm: 0.27 |
| Comparative Example | 31 | balance | 3.23 | 0.90 | Fe: 0.2, Si: 0.05 |
| | 32 | balance | 3.30 | 3.20 | — |
| | 33 | balance | 3.00 | 1.10 | Sn: 0.1 |
| | 34 | balance | 2.98 | 2.10 | — |
| | 35 | balance | 3.29 | 1.00 | Fe: 0.2 |
| | 36 | balance | 3.39 | 1.20 | — |
| | 37 | balance | 3.19 | 1.05 | — |
| | 38 | balance | 4.68 | — | — |
| | 39 | balance | 4.64 | — | — |
| | 40 | balance | 2.30 | 1.80 | — |
| | 41 | balance | 3.20 | — | Mg: 0.6 |
| | 42 | balance | 0.90 | 1.10 | — |
| | 43 | balance | 5.42 | 1.23 | — |

TABLE 1-continued

| Category | Example No. | Chemical composition (mass %) Cu | Ti | Al | Others |
|---|---|---|---|---|---|
| | 44 | balance | 3.30 | 0.39 | — |
| | 45 | balance | 4.30 | — | — |
| | 46 | balance | 3.33 | 1.20 | — |

Underline: outside the range specified in the present invention

TABLE 2

| Category | Example No. | Production process: Cast slab heating Temperature (° C.) | Cast slab heating Time (h) | Hot rolling Sheet thickness (mm) | Rough cold rolling Sheet thickness (mm) | First solution treatment Temperature (° C.) | First solution treatment Time (s) | First intermediate cold rolling Rolling ratio (%) | Second solution treatment Temperature (° C.) | Second solution treatment Time (s) |
|---|---|---|---|---|---|---|---|---|---|---|
| Present Inventive Example | 1 | 950 | 1 | 5 | 1.60 | 825 | 300 | 94 | 800 | 60 |
| | 2 | 950 | 2 | 5 | 1.60 | 950 | 30 | 94 | 825 | 90 |
| | 3 | 950 | 1 | 5 | 1.60 | 750 | 600 | 93 | 775 | 45 |
| | 4 | 950 | 1 | 5 | 1.60 | 825 | 300 | 93 | 850 | 60 |
| | 5 | 950 | 3 | 5 | 1.00 | 825 | 300 | 86 | 800 | 60 |
| | 6 | 950 | 3 | 5 | 1.60 | 825 | 300 | 94 | 800 | 60 |
| | 7 | 950 | 2 | 5 | 1.60 | 850 | 300 | 94 | 825 | 60 |
| | 8 | 950 | 3 | 5 | 0.40 | 850 | 180 | 75 | 850 | 120 |
| | 9 | 950 | 3 | 5 | 1.60 | 825 | 300 | 94 | 800 | 60 |
| | 10 | 950 | 3 | 5 | 1.60 | 825 | 360 | 93 | 825 | 60 |
| | 11 | 950 | 2 | 5 | 1.60 | 825 | 300 | 93 | 825 | 60 |
| | 12 | 950 | 1 | 5 | 1.60 | 825 | 300 | 94 | 800 | 60 |
| | 13 | 950 | 1 | 5 | 1.60 | 875 | 180 | 94 | 800 | 60 |
| | 14 | 950 | 1 | 5 | 1.60 | 825 | 300 | 94 | 800 | 60 |
| | 15 | 950 | 1 | 5 | 1.60 | 825 | 300 | 94 | 800 | 60 |
| | 16 | 950 | 1 | 5 | 1.60 | 825 | 300 | 94 | 800 | 60 |

| Category | Example No. | Production process: Second intermediate cold rolling Rolling ratio (%) | Aging treatment Temperature (° C.) | Aging treatment Time (s) | Finish cold rolling Rolling ratio (%) | Low-temperature annealing Temperature (° C.) | Low-temperature annealing Time (s) | Final sheet thickness (mm) |
|---|---|---|---|---|---|---|---|---|
| Present Inventive Example | 1 | 20 | 350 | 12 | — | — | — | 0.08 |
| | 2 | 20 | 400 | 12 | — | — | — | 0.08 |
| | 3 | 27 | 375 | 12 | — | — | — | 0.08 |
| | 4 | 17 | 375 | 12 | 20 | 450 | 40 | 0.08 |
| | 5 | 29 | 375 | 12 | 20 | 450 | 40 | 0.08 |
| | 6 | 20 | 400 | 12 | — | — | — | 0.08 |
| | 7 | 20 | 425 | 12 | — | — | — | 0.08 |
| | 8 | 20 | 400 | 12 | — | — | — | 0.08 |
| | 9 | 20 | 400 | 12 | — | — | — | 0.08 |
| | 10 | 33 | 375 | 12 | — | — | — | 0.08 |
| | 11 | 17 | 330 | 16 | 20 | 450 | 40 | 0.08 |
| | 12 | 20 | 375 | 12 | — | — | — | 0.08 |
| | 13 | 20 | 400 | 12 | — | — | — | 0.08 |
| | 14 | 20 | 350 | 12 | — | — | — | 0.08 |
| | 15 | 20 | 350 | 12 | — | — | — | 0.08 |
| | 16 | 20 | 350 | 12 | — | — | — | 0.08 |

TABLE 3

| | | Production process | | | | | | | | |
|---|---|---|---|---|---|---|---|---|---|---|
| | | Cast slab heating | | Hot rolling Sheet | Rough cold rolling Sheet | First solution treatment | | First intermediate cold rolling | Second solution treatment | |
| Category | Example No. | Temperature (° C.) | Time (h) | thickness (mm) | thickness (mm) | Temperature (° C.) | Time (s) | Rolling ratio (%) | Temperature (° C.) | Time (s) |
| Comparative Example | 31 | 950 | 1 | 5 | 0.10 | 850 | 60 | — | — | — |
| | 32 | 950 | 1 | 5 | 1.60 | 825 | 300 | 94 | 800 | 60 |
| | 33 | 950 | 1 | 5 | 1.60 | 725 | 700 | 94 | 850 | 60 |
| | 34 | 950 | 1 | 5 | 1.60 | 975 | 30 | 94 | 825 | 60 |
| | 35 | 950 | 1 | 5 | 0.30 | 825 | 240 | 60 | 800 | 60 |
| | 36 | 950 | 1 | 5 | 2.00 | 950 | 360 | 90 | 875 | 60 |
| | 37 | 950 | 1 | 5 | 1.60 | 825 | 300 | 75 | 800 | 60 |
| | 38 | 950 | 1 | 5 | 0.084 | 900 | 50 | — | 600[*1] | 50[*1] |
| | 39 | 950 | 1 | 2 | 0.20 | 1000 | 15 | — | — | — |
| | 40 | 900 | 2 | — | — | — | — | — | — | — |
| | 41 | 950 | 1 | — | 0.10 | 850 | 1800 | — | — | — |
| | 42 | 950 | 1 | 5 | 1.60 | 800 | 300 | 93 | 775 | 60 |
| | 43 | 950 | 1 | 5 | 1.60 | 800 | 300 | 93 | 825 | 60 |
| | 44 | 950 | 1 | 5 | 1.60 | 800 | 300 | 93 | 800 | 60 |
| | 45 | 950 | 3 | 5 | 0.10 | 850 | 120 | — | — | — |
| | 46 | 950 | 1 | 5 | 1.60 | 825 | 300 | 93 | 650 | 60 |

| | | Production process | | | | | | |
|---|---|---|---|---|---|---|---|---|
| | | Second intermediate cold rolling | Aging treatment | | Finish cold rolling | Low-temperature annealing | | Final |
| Category | Example No. | Rolling ratio (%) | Temperature (° C.) | Time (s) | Rolling ratio (%) | Temperature (° C.) | Time (s) | sheet thickness (mm) |
| Comparative Example | 31 | 20 | 375 | 12 | — | — | — | 0.08 |
| | 32 | 20 | 425 | 12 | — | — | — | 0.08 |
| | 33 | 20 | 375 | 12 | — | — | — | 0.08 |
| | 34 | 20 | 400 | 12 | — | — | — | 0.08 |
| | 35 | 33 | 400 | 12 | — | — | — | 0.08 |
| | 36 | 60 | 350 | 12 | — | — | — | 0.08 |
| | 37 | 50 | 400 | 12 | 60 | 450 | 40 | 0.08 |
| | 38 | 5 | 400 | 3.5 | — | — | — | 0.08 |
| | 39 | 25 | 375 | 12 | — | — | — | 0.15 |
| | 40 | — | 450 | 8 | — | — | — | — |
| | 41 | — | 450 | 10 | — | — | — | 0.10 |
| | 42 | 33 | 350 | 12 | — | — | — | 0.08 |
| | 43 | 33 | 425 | 12 | — | — | — | 0.08 |
| | 44 | 27 | 400 | 12 | — | — | — | 0.08 |
| | 45 | 20 | 375 | 12 | — | — | — | 0.08 |
| | 46 | 33 | 375 | 12 | — | — | — | 0.08 |

Underline: outside the range specified in the present invention/
[*1]performed as preliminary aging (precursory treatment)

TABLE 4

| | | Texture | | | | Properties | | | | |
|---|---|---|---|---|---|---|---|---|---|---|
| Category | Example No. | Average crystal grain diameter (μm) | Maximum width of grain boundary reaction type precipitate existing region (nm) | Number density of fine precipitate particles (particles/mm$^2$) | KAM value (°) | Tensile strength (MPa) | Electrical conductivity (% IACS) | 90° W Bending MBR/t | 250° C. × 100 h stress relaxation ratio (%) | Density (g/cm$^3$) |
| Present Inventive Example | 1 | 3 | 425 | $1.9 \times 10^{10}$ | 1.20 | 894 | 12.4 | 0.00 | 14 | 8.48 |
| | 2 | 6 | 859 | $8.8 \times 10^{11}$ | 1.21 | 1021 | 13.2 | 2.00 | 6 | 8.40 |
| | 3 | 5 | 315 | $2.5 \times 10^{8}$ | 1.41 | 856 | 16.2 | 0.00 | 14 | 8.32 |
| | 4 | 4 | 431 | $1.8 \times 10^{10}$ | 2.34 | 989 | 11.3 | 1.50 | 12 | 8.47 |
| | 5 | 7 | 581 | $3.1 \times 10^{11}$ | 2.81 | 1110 | 11.9 | 2.00 | 14 | 8.50 |
| | 6 | 10 | 734 | $5.8 \times 10^{11}$ | 1.08 | 975 | 14.7 | 1.00 | 7 | 8.50 |
| | 7 | 5 | 297 | $8.8 \times 10^{8}$ | 1.33 | 885 | 10.7 | 0.63 | 5 | 8.16 |
| | 8 | 16 | 638 | $6.1 \times 10^{11}$ | 0.68 | 998 | 12.7 | 1.00 | 6 | 8.48 |
| | 9 | 5 | 629 | $2.2 \times 10^{9}$ | 1.19 | 910 | 12.4 | 0.63 | 5 | 8.48 |
| | 10 | 4 | 431 | $8.5 \times 10^{8}$ | 1.91 | 899 | 10.9 | 0.63 | 7 | 8.31 |
| | 11 | 5 | 600 | $7.8 \times 10^{9}$ | 2.42 | 984 | 12.5 | 1.50 | 13 | 8.48 |

TABLE 4-continued

| Category | Example No. | Texture: Average crystal grain diameter (μm) | Texture: Maximum width of grain boundary reaction type precipitate existing region (nm) | Texture: Number density of fine precipitate particles (particles/mm$^2$) | Texture: KAM value (°) | Properties: Tensile strength (MPa) | Properties: Electrical conductivity (% IACS) | Properties: 90° W Bending MBR/t | Properties: 250° C. × 100 h stress relaxation ratio (%) | Properties: Density (g/cm$^3$) |
|---|---|---|---|---|---|---|---|---|---|---|
| | 12 | 4 | 441 | $8.6 \times 10^8$ | 1.31 | 894 | 14.5 | 0.63 | 13 | 8.53 |
| | 13 | 4 | 920 | $7.0 \times 10^{11}$ | 1.64 | 1021 | 12.7 | 1.50 | 6 | 8.41 |
| | 14 | 3 | 380 | $3.8 \times 10^{10}$ | 1.40 | 921 | 11.1 | 0.00 | 13 | 8.45 |
| | 15 | 3 | 375 | $2.9 \times 10^{10}$ | 1.30 | 908 | 11.4 | 0.00 | 13 | 8.46 |
| | 16 | 3 | 415 | $5.9 \times 10^{10}$ | 1.36 | 935 | 10.8 | 0.63 | 11 | 8.47 |

TABLE 5

| Category | Example No. | Texture: Average crystal grain diameter (μm) | Texture: Maximum width of grain boundary reaction type precipitate existing region (nm) | Texture: Number density of fine precipitate particles (particles/mm$^2$) | Texture: KAM value (°) | Properties: Tensile strength (MPa) | Properties: Electrical conductivity (% IACS) | Properties: 90° W Bending MBR/t | Properties: 250° C. × 100 h stress relaxation ratio (%) | Properties: Density (g/cm$^3$) |
|---|---|---|---|---|---|---|---|---|---|---|
| Comparative Example | 31 | 3 | 1877 | $1.2 \times 10^{10}$ | 1.81 | 948 | 13.5 | 2.50 | 12 | 8.50 |
| | 32 | 5 | 296 | $4.5 \times 10^8$ | 1.14 | 867 | 7.5 | 0.63 | 13 | 8.10 |
| | 33 | 5 | 1026 | $1.8 \times 10^7$ | 1.27 | 830 | 13.5 | 2.50 | 14 | 8.49 |
| | 34 | 22 | 533 | $5.0 \times 10^8$ | 1.11 | 842 | 10.5 | 1.00 | 15 | 8.31 |
| | 35 | 23 | 617 | $1.8 \times 10^9$ | 1.54 | 826 | 14.8 | 1.50 | 11 | 8.49 |
| | 36 | 5 | 569 | $1.0 \times 10^{10}$ | 3.65 | 1074 | 13.2 | 3.00 | 14 | 8.45 |
| | 37 | 5 | 581 | $2.1 \times 10^{10}$ | 4.42 | 1100 | 11.8 | 3.50 | 12 | 8.49 |
| | 38 | 15 | 876 | $6.5 \times 10^{11}$ | 2.00 | 1005 | 14.7 | 1.50 | 14 | 8.56 |
| | 39 | 31 | 1166 | $7.8 \times 10^{11}$ | 1.13 | 946 | 13.0 | 2.50 | 13 | 8.57 |
| | 40 | 56 | 2348 | $9.8 \times 10^7$ | 0.27 | 610 | 7.0 | 0.63 | 11 | 8.42 |
| | 41 | 47 | 2682 | $4.2 \times 10^7$ | 0.69 | 652 | 13.0 | 0.63 | 12 | 8.48 |
| | 42 | 5 | 600 | $8.8 \times 10^7$ | 1.49 | 732 | 16.7 | 0.63 | 11 | 8.66 |
| | 43 | 4 | 963 | $6.7 \times 10^{12}$ | 1.45 | 1098 | 11.8 | 3.00 | 10 | 8.29 |
| | 44 | 6 | 626 | $8.0 \times 10^9$ | 1.32 | 927 | 13.1 | 1.00 | 12 | 8.60 |
| | 45 | 16 | 2183 | $5.0 \times 10^7$ | 2.01 | 984 | 16.4 | 2.50 | 11 | 8.60 |
| | 46 | 21 | 483 | $2.2 \times 10^6$ | 1.07 | 834 | 13.4 | 1.50 | 8 | 8.45 |

Underline: outside the range specified in the present invention or insufficient property All the sheet materials of Present Inventive Examples, in which the chemical composition and the production conditions were strictly controlled according to the above-mentioned specification, had favorable strength, electrical conductivity, bending workability, and stress relaxation property, and also had an excellent effect of reducing the density (specific gravity).

On the other hand, in No. 31 which is Comparative Example, the solution treatment was performed only once, and therefore, the maximum width of the grain boundary reaction type precipitate existing region became larger, and the bending workability was poor.

In No. 32, the Al content was too high, and therefore, the electrical conductivity decreased.

In No. 33, the temperature in the first solution treatment was low, and therefore, the solid-dissolution of the precipitate phase was insufficient, and the maximum width of the grain boundary reaction type precipitate existing region was large, and the bending workability was poor. In addition, the precipitation amount of fine precipitates was insufficient, and the strength was also low.

In No. 34, the temperature in the first solution treatment was too high, and therefore, crystal grains were coarsened, and the strength was low.

In No. 35, the rolling ratio in the first intermediate cold rolling was low, and therefore, the crystal grains could not be refined in the second solution treatment, and the strength was low.

In No. 36, the rolling ratio in the second intermediate cold rolling was too high, and therefore, the KAM value became too large, and the bending workability was poor.

In No. 37, the rolling ratio in the finish cold rolling was too high, and therefore, the KAM value became too large, and the bending workability was poor.

In No. 38, Al is not contained, and therefore, the effect of reducing the density (specific gravity) is not obtained.

In No. 39, Al is not contained, and therefore, the effect of reducing the density (specific gravity) is not obtained. In addition, a step of performing the solution treatment at a high temperature once was adopted, and therefore, the maximum width of the grain boundary reaction type precipitate existing region became larger, and the bending workability was poor.

No. 40 is an example in which the rolling step is not performed. In this case, the material is soft, and therefore, although the maximum width of the grain boundary reaction type precipitate existing region was large, the bending workability was good. However, the amount of generated fine precipitates was small, and the electrical conductivity was low. In addition, the amount of fine precipitates was small and the average crystal grain diameter was large, and therefore, the strength was also low.

In No. 41, Al is not contained, but Mg is contained, and therefore, the effect of reducing the density (specific gravity) could be obtained. However, a high strength was not achieved.

In No. 42, the Ti content was low, and therefore, the amount of generated fine precipitates was insufficient, and the strength was low. In addition, the effect of reducing the density (specific gravity) was not obtained.

In No. 43, the Ti content was too high, and therefore, fine precipitates were generated excessively, and the bending workability was poor.

In No. 44, the Al content was low, and therefore, the effect of reducing the density (specific gravity) was not obtained.

In No. 45, Al was not contained, and therefore, the effect of reducing the density (specific gravity) was not obtained. In addition, the solution treatment was performed only once, and therefore, the maximum width of the grain boundary reaction type precipitate existing region became larger, and the bending workability was poor.

In No. 46, the temperature in the second solution treatment was low, and therefore, the refinement of crystal grains was insufficient, and the strength was low.

For reference, in FIGS. 1 to 3, an SEM photograph of the observation plane prepared by electropolishing the sheet surface of the Cu—Ti-based alloy sheet material obtained in Comparative Example No. 45 is shown. Further, in FIGS. 4 to 6, an SEM photograph of the observation plane prepared by electropolishing the sheet surface of the Cu—Ti-based alloy sheet material obtained in Present Inventive Example No. 1 is shown. The length of the white scale bar at the bottom of each photograph corresponds to 10 μm in FIGS. 1 and 4 and 1 μm in FIGS. 2, 3, 5, and 6.

The invention claimed is:

1. A copper alloy sheet material, having a composition comprising, in mass %, Ti: 1.0 to 5.0%, Al: 0.5 to 3.0%, Ag: 0 to 0.3%, B: 0 to 0.3%, Be: 0 to 0.15%, Co: 0 to 1.0%, Cr: 0 to 1.0%, Fe: 0 to 1.0%, Mg: 0 to 0.5%, Mn: 0 to 1.5%, Nb: 0 to 0.5%, Ni: 0 to 1.0%, P: 0 to 0.2%, Si: 0 to 0.5%, Sn: 0 to 1.5%, V: 0 to 1.0%, Zn: 0 to 2.0%, Zr: 0 to 1.0%, and S: 0 to 0.2%, the total content of Ag, B, Be, Co, Cr, Fe, Mg, Mn, Nb, Ni, P, Si, Sn, V, Zn, Zr, and S among the elements being 3.0% or less, and balance of Cu, with unavoidable impurities, wherein in an observation plane parallel to a sheet surface, a maximum width of a grain boundary reaction type precipitate existing region is 1000 nm or less, a KAM value is 3.0° or less when a boundary with a crystal orientation difference of 15° or more in the measurement with a step size of 0.1 μm by EBSD (electron backscatter diffraction) of the observation plane parallel to the sheet surface is regarded as a crystal grain boundary, and a tensile strength in a rolling direction is 850 MPa or more.

2. The copper alloy sheet material according to claim 1, having a composition further comprising rare earth elements in an amount within a range of 3.0 mass % or less in total.

3. The copper alloy sheet material according to claim 1, wherein a number density of fine precipitate particles having a major axis of 5 to 100 nm in the observation plane parallel to the sheet surface is $1.0\times10^8$ particles/mm$^2$ or more and $1.0\times10^{12}$ particles/mm$^2$ or less.

4. The copper alloy sheet material according to claim 1, wherein an average crystal grain diameter measured by a cutting method in accordance with JIS H 0501-1986 in the observation plane parallel to the sheet surface is 2 to 20 μm.

5. The copper alloy sheet material according to claim 1, wherein MBR/t is 2.0 or less, MBR/t being a ratio of a minimum bending radius MBR without cracking to a sheet thickness t in a W bending test in B.W. in accordance with Japan Copper and Brass Association Technical Standard JCBA T307:2007.

6. The copper alloy sheet material according to claim 1, wherein an electrical conductivity is 10.0% IACS or more.

7. The copper alloy sheet material according to claim 1, wherein a density is 8.53 g/cm$^3$ or less.

8. The copper alloy sheet material according to claim 1, wherein a sheet thickness is 0.02 to 0.50 mm.

9. A method for producing the copper alloy sheet material according to claim 1, comprising a step of producing the copper alloy sheet material by subjecting an intermediate product sheet material having a composition comprising, in mass %, Ti: 1.0 to 5.0%, Al: 0.5 to 3.0%, Ag: 0 to 0.3%, B: 0 to 0.3%, Be: 0 to 0.15%, Co: 0 to 1.0%, Cr: 0 to 1.0%, Fe: 0 to 1.0%, Mg: 0 to 0.5%, Mn: 0 to 1.5%, Nb: 0 to 0.5%, Ni: 0 to 1.0%, P: 0 to 0.2%, Si: 0 to 0.5%, Sn: 0 to 1.5%, V: 0 to 1.0%, Zn: 0 to 2.0%, Zr: 0 to 1.0%, and S: 0 to 0.2%, the total content of Ag, B, Be, Co, Cr, Fe, Mg, Mn, Nb, Ni, P, Si, Sn, V, Zn, Zr, and S among the elements being 3.0% or less, and the balance of Cu, with unavoidable impurities, to a first solution treatment, first intermediate cold rolling, a second solution treatment, second intermediate cold rolling, and an aging treatment in this order, wherein the first solution treatment is performed under the condition of holding in a temperature range of 750 to 950° C. for 10 to 600 seconds, the first intermediate cold rolling is performed at a rolling ratio of 70% or more, the second solution treatment is performed under the condition of holding in a temperature range of 750 to 900° C. for 10 to 600 seconds, the second intermediate cold rolling is performed at a rolling ratio of 15 to 50%, and the aging treatment is performed at an aging temperature of 300 to 470° C.

10. The method for producing the copper alloy sheet material according to claim 9, wherein the intermediate product sheet material has a composition further containing rare earth elements in an amount within a range of 3.0 mass % or less in total.

11. The method for producing the copper alloy sheet material according to claim 9, wherein in a step of producing the copper alloy sheet material by further performing finish cold rolling and low-temperature annealing in this order after the aging treatment, the finish cold rolling is performed at a rolling ratio of 50% or less, and the low-temperature annealing is performed under the condition of holding in a temperature range of 350 to 550° C. for 60 seconds or less.

12. An electric current carrying component using the copper alloy sheet material according to claim 1 as a material.

13. A heat radiation component using the copper alloy sheet material according to claim 1 as a material.

* * * * *